US011767581B2

(12) United States Patent
Liu et al.

(10) Patent No.: US 11,767,581 B2
(45) Date of Patent: Sep. 26, 2023

(54) HIGH NITROGEN STEEL WITH HIGH STRENGTH, LOW YIELD RATIO AND HIGH CORROSION RESISTANCE FOR OCEAN ENGINEERING AND PREPARATION METHOD THEREFOR

(71) Applicant: North China University of Science and Technology, Tangshan (CN)

(72) Inventors: Jimeng Liu, Tangshan (CN); Shuhuan Wang, Tangshan (CN); Dingguo Zhao, Tangshan (CN); Yuekai Xue, Tangshan (CN); Hao Li, Tangshan (CN); Cunshuai Zhang, Tangshan (CN)

(73) Assignee: North China University of Science and Technology, Tangshan (CN)

( * ) Notice: Subject to any disclaimer, the term of this patent is extended or adjusted under 35 U.S.C. 154(b) by 0 days.

(21) Appl. No.: 17/966,900

(22) Filed: Oct. 17, 2022

(65) Prior Publication Data

US 2023/0115623 A1 Apr. 13, 2023

(30) Foreign Application Priority Data

Nov. 4, 2021 (CN) ..... 202111301480.1

(51) Int. Cl.

| | |
|---|---|
| ***C22C 38/00*** | (2006.01) |
| ***C22C 38/02*** | (2006.01) |
| ***C22C 38/22*** | (2006.01) |
| ***C22C 38/28*** | (2006.01) |
| ***C22C 38/04*** | (2006.01) |

(Continued)

(52) U.S. Cl.

CPC ..... *C22C 38/001* (2013.01); *B21J 1/06* (2013.01); *C21D 8/0226* (2013.01); *C22C 33/04* (2013.01); *C22C 38/002* (2013.01); *C22C 38/02* (2013.01); *C22C 38/04* (2013.01); *C22C 38/22* (2013.01); *C22C 38/28* (2013.01)

(58) Field of Classification Search

None

See application file for complete search history.

(56) References Cited

U.S. PATENT DOCUMENTS

| | | | |
|---|---|---|---|
| 2006/0034724 | A1 | 2/2006 | Hamano et al. |
| 2007/0098588 | A1 | 5/2007 | Narita et al. |
| 2022/0134424 | A1 | 5/2022 | Mohanty et al. |

FOREIGN PATENT DOCUMENTS

CN 102199738 A * 9/2011

* cited by examiner

*Primary Examiner* — Anthony M Liang

(74) *Attorney, Agent, or Firm* — Zhigang Ma

(57) ABSTRACT

The present invention discloses a high nitrogen steel with high strength, low yield ratio and high corrosion resistance for ocean engineering, comprising the following chemical components by weight percentage: C≤0.01%, Si≤0.1%, Cr 17%-19%, Mn 14%-16%, Mo 1%-1.5%, Ti≤0.05%, N 0.45%-0.6%, P≤0.01%, S≤0.01%, O≤0.02%, and the balance of iron. The present invention also discloses a preparation method as follows: (1) raw material weighing; (2) ingot preparation, remelting and smelting; (3) solution and forging treatments; and (4) hot rolling and post-rolling treatment. A product provided by the present invention has high tensile strength, low yield ratio and high corrosion resistance. At the same time, the present invention does not need pressurized equipment in the preparation process, therefore the preparation method is simple, the cost is low, and the present invention is suitable for industrial popularization in China.

8 Claims, 5 Drawing Sheets

(51) Int. Cl.

| | |
|---|---|
| ***C21D 8/02*** | (2006.01) |
| ***B21J 1/06*** | (2006.01) |
| ***C22C 33/04*** | (2006.01) |

HIGH NITROGEN STEEL WITH HIGH STRENGTH, LOW YIELD RATIO AND HIGH CORROSION RESISTANCE FOR OCEAN ENGINEERING AND PREPARATION METHOD THEREFOR

TECHNICAL FIELD

The present invention relates to the technical field of iron and steel metallurgy, and in particular to a high nitrogen steel with high strength, low yield ratio and high corrosion resistance for ocean engineering and a preparation method therefor.

BACKGROUND

Low alloy steel and carbon steel with excellent mechanical properties are commonly used as structural materials, but will rust in the marine environment, thus requiring frequent anti-corrosion treatment. Whereas stainless steel with good corrosion resistance is generally high alloy steel and contains a large amount of strategic element nickel, which is expensive. High nitrogen steel with high strength, low yield ratio and high corrosion resistance for ocean engineering is a green, environment-friendly and resource-saving product.

Pressure metallurgy is an effective method for preparing high nitrogen steel, and some foreign countries have used pressure metallurgy to produce such high nitrogen steel commercially. Due to the complexity of pressurized equipment, high production cost, and certain safety risks, and restricted by production equipment, industrialized production has not yet been achieved in China. However, during solidification of liquid steel at atmospheric pressure, the problems such as nitrogen segregation, nitrogen escape and blistering can be easily caused by nitrogen, which seriously restrict the development and application of high nitrogen steel varieties.

Domestic colleges, universities and scientific research institutions have paid more attention to the smelting process of high nitrogen steel, but research on integrated property regulation of the whole process of smelting, hot rolling and post-rolling heat treatment of high nitrogen steel is relatively weak. Ocean engineering steel in China is generally divided into general strength steel of 235-305 MPa, high-strength steel of 315-400 MPa, ultra-high strength steel of 410-685 MPa, etc., and it is stipulated that for high-strength steel, a yield ratio of lower than 0.85 is a low yield ratio. Steel with a low yield ratio has a relatively high uniform elongation rate, and when the steel is subject to a violent external impact, a large degree of plastic deformation will occur, thus to absorb and store energy, so that the steel will not suddenly fracture due to local overload or deformation, which greatly improves the safety of steel use. However, in the prior art, the yield ratio of steel will rise with the increase of strength.

Therefore, the problem to be urgently solved by those skilled in the art is how to reduce the required pressure during steel preparation while increasing the strength of the steel and reducing the yield ratio.

SUMMARY

In view of this, the present invention provides a high nitrogen steel with high strength, low yield ratio and high corrosion resistance for ocean engineering requiring no pressurized equipment and a preparation method therefor.

To achieve the above purpose, the present invention adopts the following technical solution:

A high nitrogen steel with high strength, low yield ratio and high corrosion resistance for ocean engineering, comprising the following chemical components by weight percentage: C≤0.01%, Si≤0.1%, Cr 17%-19%, Mn 14%-16%, Mo 1%-1.5%, Ti≤0.05%, N 0.45%-0.6%, P≤0.01%, S≤0.01%, O≤0.02%, and the balance of iron and trace impurities.

Preferably, the present invention comprises the following chemical components by weight percentage: C 0.005%-0.01%, Si 0.05%-0.1%, Cr 17%-19%, Mn 14%-16%, Mo 1%-1.5%, Ti 0.005%-0.05%, N 0.45%-0.6%, P 0.005%-0.01%, S 0.005%-0.01%, O 0.01%-0.02%, and the balance of iron.

Beneficial effects: the present invention uses nitrogen instead of nickel, which reduces the cost, nitrogen in steel can effectively improve the strength and corrosion resistance of the material without reducing the plasticity of the material, and at the same time, nitrogen and molybdenum have a synergistic effect in corrosion resistance; titanium can increase the solubility of nitrogen in the material, and form fine titanium nitride precipitate with nitrogen, so that the grain size of the material is small and the structure is more uniform.

A preparation method for the high nitrogen steel with high strength, low yield ratio and high corrosion resistance for ocean engineering, comprising the following steps:

(1) Raw material weighing: calculating and weighing raw materials including industrial pure iron, low carbon ferrochromium, electrolytic manganese, ferromolybdenum, chromium nitride, nitrogenized manganese, aluminum and titanium for later use;

(2) Ingot preparation, remelting and smelting: melting, casting and cooling the above raw materials to form an ingot, and carrying out electroslag remelting and smelting of the ingot under nitrogen protection, thus to obtain an electroslag ingot;

(3) Solution and forging treatments: carrying out solution treatment of the electroslag ingot at 1000° C.-1050° C. for 20 h-24 h and then cooling the electroslag ingot by water; carrying out forging treatment with an initial forging temperature of not less than 1050° C. and a final forging temperature of not less than 900° C. during forging; after forging, cooling the electroslag ingot to room temperature by air, thus to obtain a square billet; and (4) Hot rolling and post-rolling treatment: placing the square billet in a heating furnace, soaking at 1050° C. for 2 h, and raising the temperature to 1100° C. within 0.5 h; starting hot rolling at 1000-1050° C., and finishing the hot rolling at 890-930° C.; after rolling, cooling the square billet to room temperature by air or water, thus to obtain the high nitrogen steel for ocean engineering.

Beneficial effects: the high nitrogen steel for ocean engineering produced according to the present invention has a tensile strength of higher than 500 MPa, which belongs to ultra-high strength steel in ocean engineering steel; the yield ratio is lower than 0.85, and the yield ratio after heat treatment reaches 0.56; and the corrosion resistance is better than that of 316L steel with a higher price.

Preferably, the calculation in step (1) comprises determining nitrogen content in the components using a formula ① which is as follows:

$$[\%\ N]_1=[\%\ N]-(0.2-0.4);$$

Where, $[\% N]_1$ represents a target nitrogen mass percentage of the ingot;

[% N] represents a calculated nitrogen mass percentage of the high nitrogen steel.

Beneficial effects: the high nitrogen steel provided by the present invention will pass through a ferrite phase region with a particularly low amount of dissolved nitrogen during solidification from liquid phase to solid phase, and nitrogen will escape when the liquid steel solidifies; adding an excess amount of nitralloy, and in combination with rapid cooling and casting, the liquid steel can quickly pass through the ferrite phase region, so that nitrogen is supersaturated in the steel and the nitrogen content in the ingot can be increased.

Preferably, the ingot preparation in step (2) comprises the following steps:

Placing the industrial pure iron, the low carbon ferrochromium, ½-⅔ by weight of the electrolytic manganese and the ferromolybdenum in a crucible of an induction furnace with a vacuum degree of 17 Pa for melting completely; introducing nitrogen to replace air, and using the nitrogen to stir liquid steel uniformly; then adding the remaining electrolytic manganese into the furnace in batches by 2-3 times, and heating and soaking until the remaining electrolytic manganese is completely melted; adding the chromium nitride, the nitrogenized manganese and the aluminum in batches by 3-6 times in turn, and carrying out deoxidation; and finally adding the titanium, heating and soaking until the titanium is completely melted, and sampling and carrying out rapid casting and cooling, thus to obtain the ingot.

Beneficial effects: oxygen in the liquid steel is a surface active element, which can inhibit the dissolution of nitrogen in the liquid steel; if oxygen content is too high, the inclusion of oxides in the steel will be increased, which will reduce the properties of the material. In the present invention, the induction furnace is vacuumized to 17 Pa and nitrogen is introduced into the furnace to replace air, both of which are to reduce oxygen in the reaction furnace and make preparations for deoxidation of the liquid steel. The electrolytic manganese added in batches at a later stage of smelting plays the function of light deoxidation. The aluminum is added at the later stage of smelting to further deoxidize the liquid steel. Part of the titanium added into the liquid steel is combined with nitrogen after entering the liquid steel, and the other part is combined with oxygen to carry out deep deoxidation of the liquid steel. Using this deoxidation condition, the negative effect of oxygen on the material can be minimized.

Preferably, the melting temperature in the crucible of the induction furnace is 1550-1560° C.

Preferably, the pressure in the crucible of the induction furnace after nitrogen is introduced is 80000 Pa.

Preferably, the casting temperature in step (2) is 1530-1560° C.

Beneficial effects: the conventional casting temperature of steel is 1580-1630° C.; after the raw materials are completed melted, the molten iron will contain the elements such as chromium, manganese and nitrogen, which can lower the solidifying point of the liquid steel; although the melting point of the industrial pure iron is 1535° C., the solidifying point of the liquid steel is lower than this temperature value; therefore, the casting temperature in the present invention is adjusted to 1530-1560° C. The casting temperature in a conventional operation is lowered in the present invention, which is favorable for the rapid solidification of the liquid steel; as the solidification time is short, the nitrogen in the liquid steel is solidified in the ingot before being able to escape, which is favorable for increasing the nitrogen content in the ingot.

Preferably, the electroslag remelting and smelting in step (3) specifically comprises the following steps:

31) Forging the ingot into a consumable electrode according to requirements of an electroslag remelting furnace, welding the consumable electrode onto a dummy electrode, and installing the dummy electrode on an electrode holder;

32) Closing a protective cover, introducing nitrogen to purge the bottom of the furnace, removing the air in the remelting furnace, carrying out electroslag remelting and smelting under the protection of high-purity nitrogen atmosphere, thus to obtain the electroslag ingot.

Preferably, in step (32), the average voltage of the electroslag remelting is 25 V, and the average current of the electroslag remelting is 2500 A.

Beneficial effects: in addition, the nitrogen in an ingot obtained by direct casting is supersaturated, nitrogen blistering in the ingot is obvious, and the main purpose of the electroslag remelting is to make the components of the ingot uniform, especially to make the nitrogen distributed uniformly. Dynamic micro-adjustment is carried out according to the melting rate during remelting, and the electroslag remelting is carried out under the protection of high-purity nitrogen atmosphere at a micro positive pressure, which can make the components of the liquid steel uniform and prevent the escape of nitrogen in the steel, thus the remelted ingot has good quality and high nitrogen content.

Preferably, in step (4), the temperature is raised to 1100° C. within 0.5 h before the forging; the initial forging temperature is 1050° C. and the final forging temperature is 900° C. during forging.

Beneficial effects: according to a Factsage phase diagram, the structure of the steel is a pure austenite structure in this temperature range, and forging in this temperature range can ensure that the steel of the present invention has low yield rate and good corrosion resistance.

It can be known from the above technical solution that compared with the prior art, the present invention discloses a high nitrogen steel with high strength, low yield ratio and high corrosion resistance for ocean engineering and a preparation method therefor; the product provided by the present invention has a tensile strength of higher than 500 MPa, which belongs to ultra-high strength steel in ocean engineering steel; the yield ratio is lower than 0.85, and the yield ratio after heat treatment reaches 0.56. After the solution treatment process provided by the present invention, the corrosion resistance of the steel of the present invention is better than that of 316, 316L and 06Cr18Ni9 steel. At the same time, the high nitrogen steel for ocean engineering provided by the present invention has low preparation cost, simple production process, no need for pressurized equipment, and low requirements on production equipment, and can be directly produced and applied by most domestic steel mills.

DESCRIPTION OF DRAWINGS

To more clearly describe the technical solution in the embodiments of the present invention or in the prior art, the drawings required to be used in the description of the embodiments or the prior art will be simply presented below. Apparently, the drawings in the following description are merely the embodiments of the present invention, and for those ordinary skilled in the art, other drawings can also be obtained according to the provided drawings without contributing creative labor.

Figure 2A:
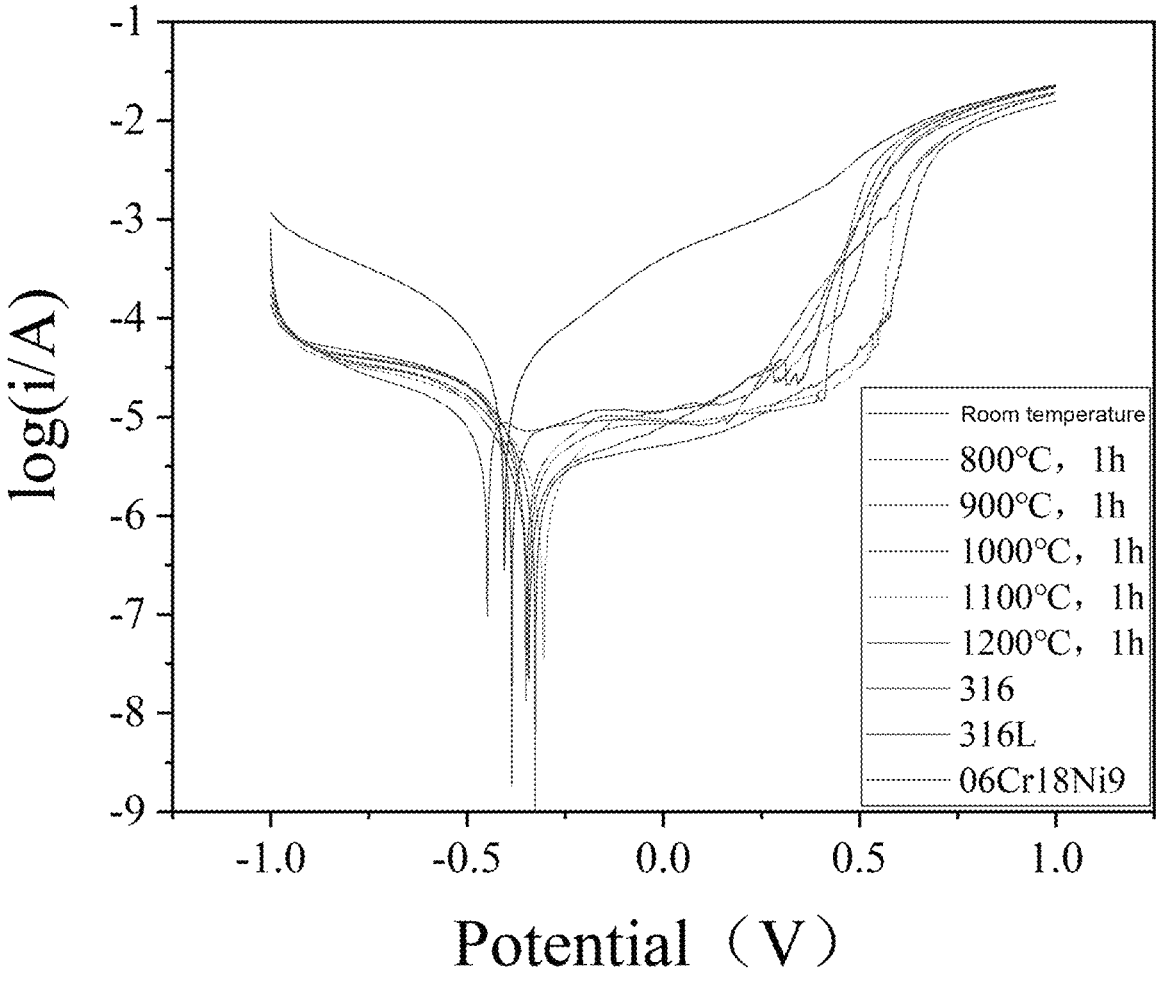
FIGS. 2(*a*)-2(*c*) shows potentiodynamic polarization curves of steel provided by embodiment 1 of the present invention as well as 316, 316L and 06Cr18Ni9 stainless steel under different solution treatment processes.
Figure 2B:
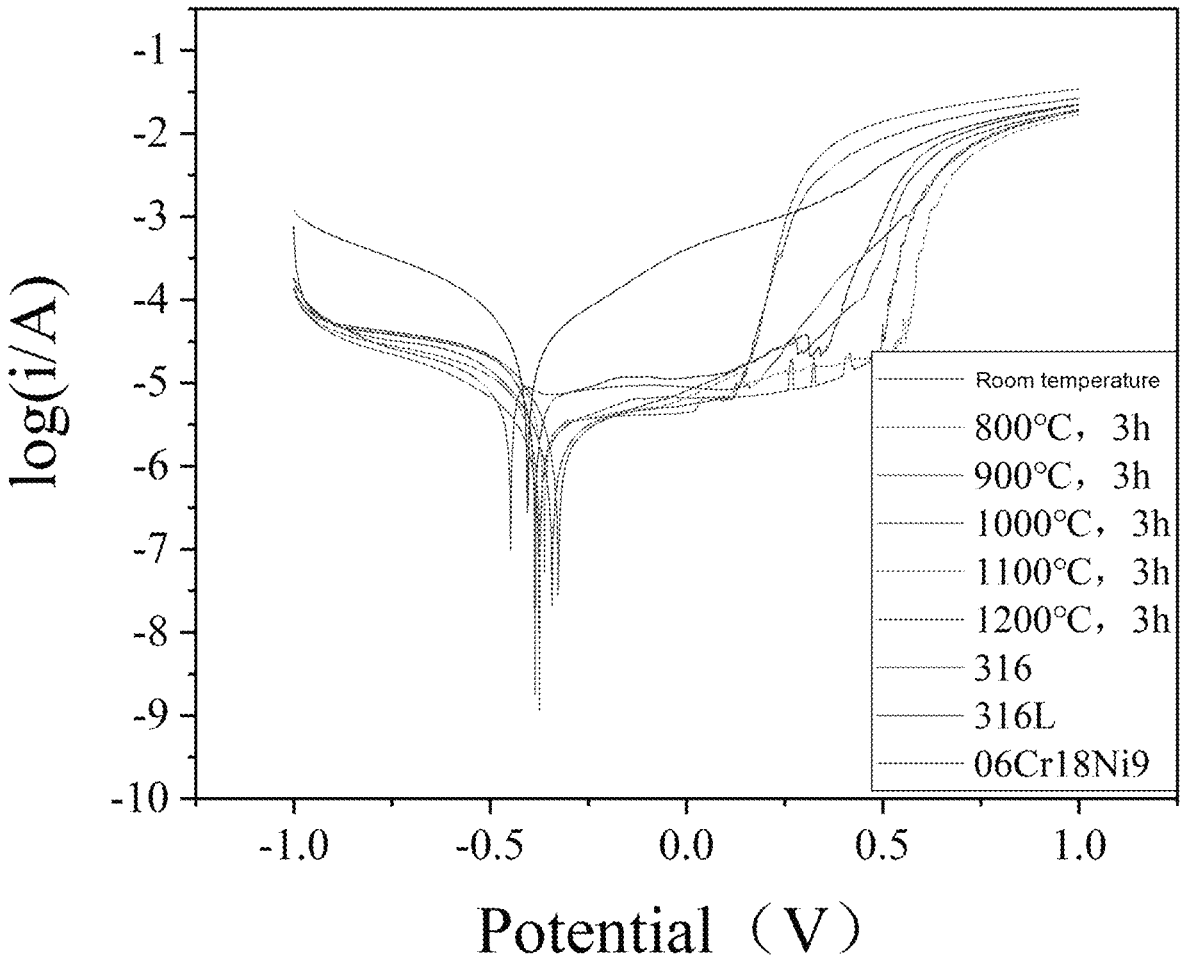
Figure 2C:
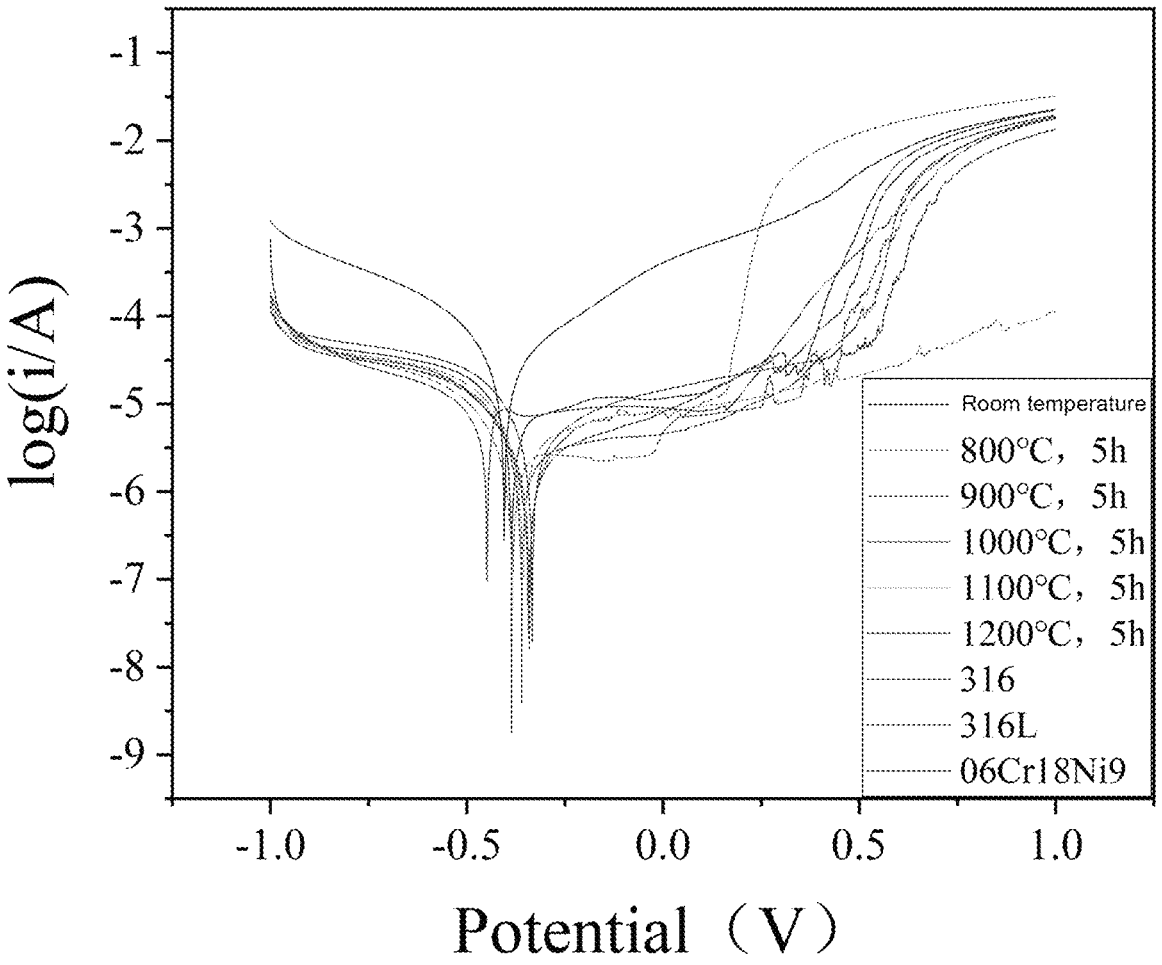
Figure 3:
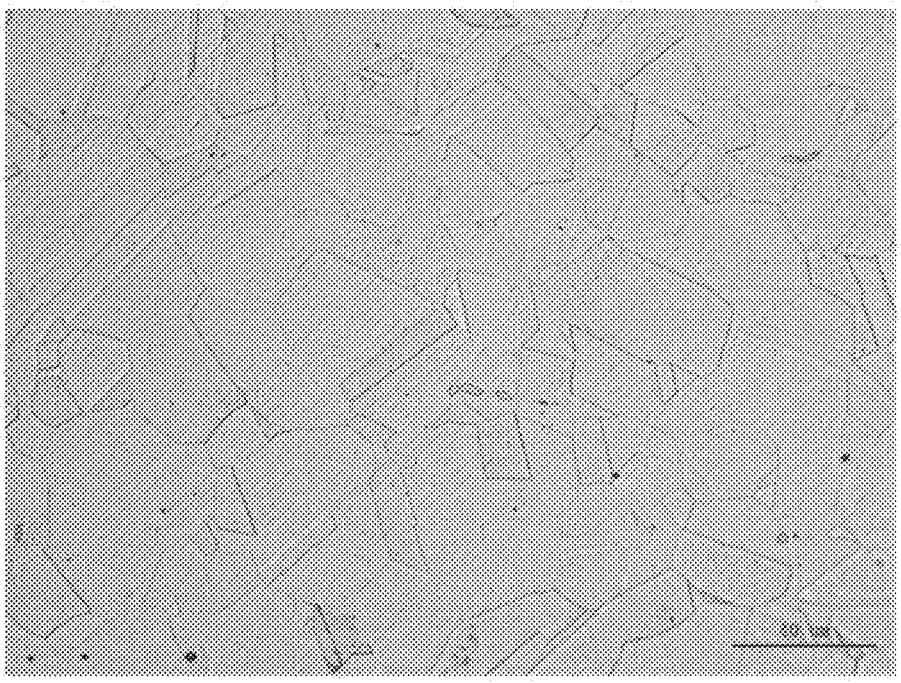

Where,

FIG. 2 (*a*) shows the potentiodynamic polarization curves of the steel provided by embodiment 1 of the present invention as well as 316, 316L and 06Cr18Ni9 stainless steel when the solution treatment temperature is room temperature and the materials are soaked at 800° C., 900° C., 1000° C., 1100° C. and 1200° C. for 1 hour:

FIG. 2 (*b*) shows the potentiodynamic polarization curves of the steel provided by embodiment 1 of the present invention as well as 316, 316L and 06Cr18Ni9 stainless steel when the solution treatment temperature is room temperature and the materials are soaked at 800° C., 900° C., 1000° C., 1100° C. and 1200° C. for 3 hours;

FIG. 2 (*c*) shows the potentiodynamic polarization curves of the steel provided by embodiment 1 of the present invention as well as 316, 316L and 06Cr18Ni9 stainless steel when the solution treatment temperature is room temperature and the materials are soaked at 800° C., 900° C., 1000° C., 1100° C. and 1200° C. for 5 hours;

FIG. 3 is a microstructure picture of steel provided by embodiment 1 of the present invention.

DETAILED DESCRIPTION

The technical solution in the embodiments of the present invention will be clearly and fully described below in combination with the drawings in the embodiments of the present invention. Apparently, the described embodiments are merely part of the embodiments of the present invention, not all of the embodiments. Based on the embodiments in the present invention, all other embodiments obtained by those ordinary skilled in the art without contributing creative labor will belong to the protection scope of the present invention.

Embodiment 1

Figure 1:
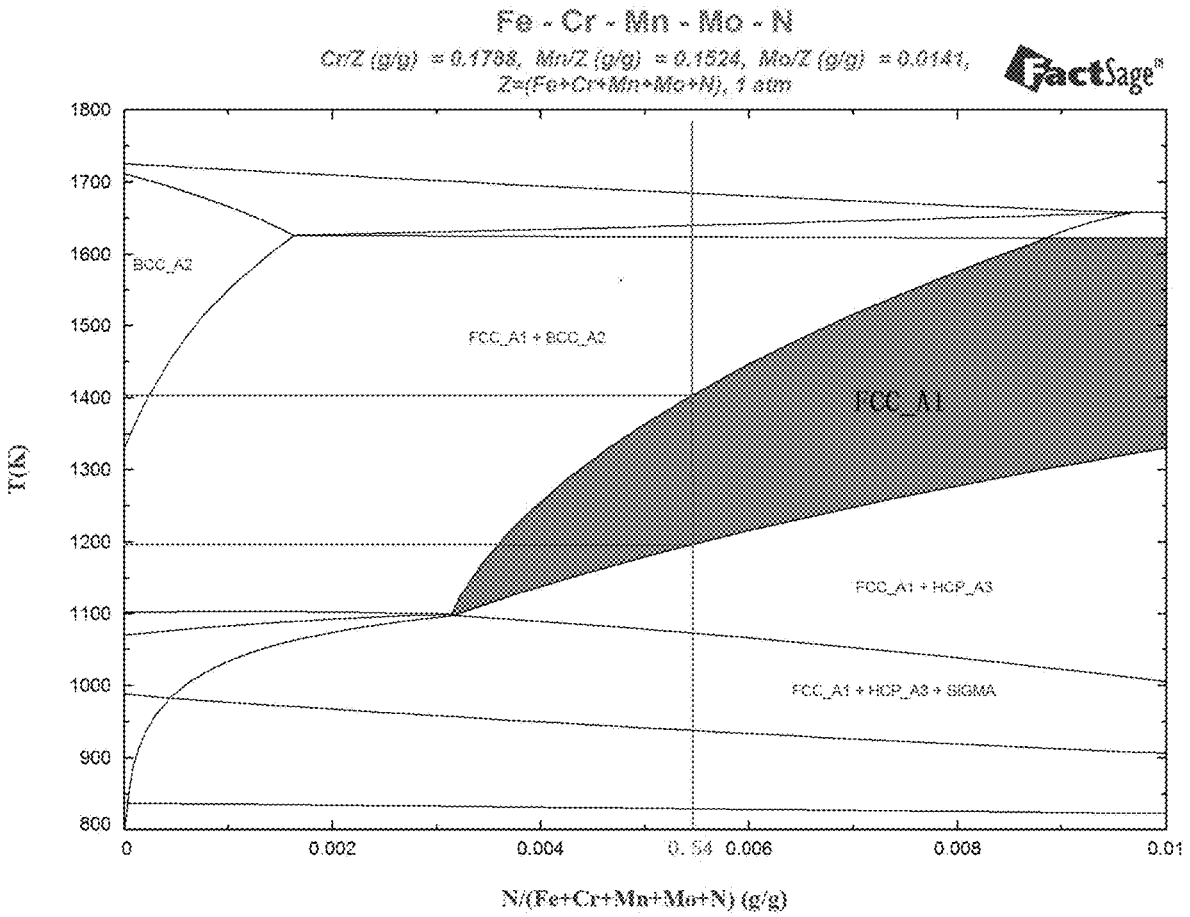
FIG. 1 shows a Factsage phase diagram of steel provided by embodiment 1 of the present invention.

A high nitrogen steel with high strength, low yield ratio and high corrosion resistance for ocean engineering, specifically comprising the following chemical components by mass percentage: C 0.009%, Cr 17.88%, Mn 15.24%, Mo 1.41%, Ti 0.0069%, N 0.53%, P 0.009%, S 0.002%, O 0.012%, and the balance of iron and residual trace impurities. The Factsage phase diagram calculated according to steel grades and components is shown in FIG. 1, and the temperature range of the heat treatment is 900-1130° C. according to the phase diagram.

A preparation method for the high nitrogen steel with high strength, low yield ratio and high corrosion resistance for ocean engineering, specifically comprising the following steps:

(1) Determining nitrogen content in the components according to a target nitrogen content of the high nitrogen steel using a formula ① which is as follows:

$$[\%\ N]_1=[\%\ N]-(0.2-0.4)$$

Where, $[\%\ N]_1$ represents a target nitrogen mass percentage of the ingot, and [% N] represents a calculated nitrogen mass percentage of the high nitrogen steel.

Calculating the weight of each raw material and preparing a smelting raw material in combination with the components of a target steel grade, the components of the smelting raw material and the weight of a smelting ingot.

(2) Ingot preparation: placing the industrial pure iron, the low carbon ferrochromium, ½ by weight of the electrolytic manganese and the ferromolybdenum in a crucible of an induction furnace, and placing the remaining electrolytic manganese in a hopper. Vacuumizing the induction furnace to 17 Pa, and energizing to raise the temperature until all the raw materials in the furnace are melted. After all the raw materials in the furnace are melted, introducing nitrogen into the furnace to a pressure of 80000 Pa and opening a bottom nitrogen blowing valve to stir the liquid steel and make the components of the liquid steel uniform; adding the electrolytic manganese into the furnace in batches by 3 times; after the added manganese is melted, adding an alloy of the chromium nitride and the nitrogenized manganese in batches by 3 times; adding aluminum for deoxidation; and finally adding titanium. Controlling the temperature in the furnace between 1550-1560° C.; after all the materials are melted, sampling and carrying out rapid casting with a casting temperature of 1540° C.; after casting, cooling to room temperature, and taking out the ingot.

(3) Remelting and smelting: forging the ingot into an electrode rod of φ=80 mm at 1100° C., welding the electrode rod onto a dummy electrode, and installing the dummy electrode on an electrode holder.

Closing a protective cover, introducing nitrogen to purge the bottom of the furnace, removing the air in the remelting furnace, setting the average voltage of the electroslag remelting to 25 V and the average current of the electroslag remelting to 2500 A, carrying out electroslag remelting and smelting under the protection of high-purity nitrogen atmosphere, thus to obtain the electroslag ingot.

Detecting the components of the sample taken out during smelting, inputting the components of the ingot into a Factsage software to calculate the phase diagram of the high nitrogen steel, and finding out the temperature range of an austenitic area according to the phase diagram, wherein the temperature range of the steel grade of the present invention is 900-1130° C.

(4) Solution and forging treatments: placing the obtained electroslag ingot in a heating furnace for solution treatment, wherein the heating temperature is 1050° C., and the in-furnace time of the casting billet is 20 h; dissolving the nitride in the electroslag ingot, recrystallizing the structure of the electroslag ingot at a high temperature, and fully austenizing the structure; and cooling by water after the solution treatment. Then carrying out forging treatment of the electroslag ingot after solution treatment, i.e., soaking at 1050° C. in the heating furnace for 2 h, and raising the temperature to 1100° C. within 0.5 h before forging, wherein the initial forging temperature is not less than 1050° C., and the final forging temperature is not less than 900° C. during forging; forging for multiple times to obtain a billet with a width of 100 mm and a thickness of 85 mm, and cooling the billet to room temperature.

(5) Hot rolling and post-rolling treatment: placing the forged square billet in the heating furnace, soaking at 1050° C. for 2 h, and raising the temperature to 1100° C. within 0.5 h; starting hot rolling at 1050° C., and finishing the hot rolling at 900° C.; after rolling, cooling the square billet to room temperature by air or water, thus to obtain the high nitrogen steel for ocean engineering.

Embodiment 2

A high nitrogen steel with high strength, low yield ratio and high corrosion resistance for ocean engineering, specifically comprising the following chemical components by mass percentage: C 0.005%, Si 0.05%, Cr 17%, Mn 14%, Mo 1%, Ti 0.005%, N 0.45%, P 0.005%, S 0.005%-0.01%, O 0.01%, and the balance of iron and residual trace impurities.

A preparation method for the high nitrogen steel with high strength, low yield ratio and high corrosion resistance for ocean engineering, specifically comprising the following steps:

(1) Determining nitrogen content in the components according to a target nitrogen content of the high nitrogen steel using a formula ① which is as follows:

$$[\%/N]_1=[\%\ N]-(0.2-0.4)$$

Where, $[\%\ N]_1$ represents a target nitrogen mass percentage of the ingot, and [% N] represents a calculated nitrogen mass percentage of the high nitrogen steel.

Calculating the weight of each raw material and preparing a smelting raw material in combination with the components of a target steel grade, the components of the smelting raw material and the weight of a smelting ingot.

(2) Ingot preparation: placing the industrial pure iron, the low carbon ferrochromium, ⅔ by weight of the electrolytic manganese and the ferromolybdenum in a crucible of an induction furnace, and placing the remaining electrolytic manganese in a hopper. Vacuumizing the induction furnace to 17 Pa, and energizing to raise the temperature until all the raw materials in the furnace are melted. After all the raw materials in the furnace are melted, introducing nitrogen into the furnace to a pressure of 80000 Pa and opening a bottom nitrogen blowing valve to stir the liquid steel and make the components of the liquid steel uniform; adding the electrolytic manganese into the furnace in batches by 2 times: after the added manganese is melted, adding an alloy of the chromium nitride and the nitrogenized manganese in batches by 5 times; adding aluminum for deoxidation; and finally adding titanium. Controlling the temperature in the furnace between 1550-1560° C.; after all the materials are melted, sampling and carrying out rapid casting with a casting temperature of 1530° C.; after casting, cooling to room temperature, and taking out the ingot.

(3) Electroslag ingot preparation: forging the ingot into an electrode rod of φ=80 mm at 1100° C., welding the electrode rod onto a dummy electrode, and installing the dummy electrode on an electrode holder.

Closing a protective cover, introducing nitrogen to purge the bottom of the furnace, removing the air in the remelting furnace, setting the average voltage of the electroslag remelting to 25 V and the average current of the electroslag remelting to 2500 A, carrying out electroslag remelting and smelting under the protection of high-purity nitrogen atmosphere, thus to obtain the electroslag ingot.

Detecting the components of the sample taken out during smelting, inputting the components of the ingot into a Factsage software to calculate the phase diagram of the high nitrogen steel, and finding out the temperature range of an austenitic area according to the phase diagram, wherein the temperature range of the steel grade of the present invention is 900-1130° C.

(4) Square billet preparation: placing the obtained electroslag ingot in a heating furnace for solution treatment; the heating temperature is 1050° C., and the in-furnace time of the casting billet is 20 h; dissolving the nitride in the electroslag ingot, and recrystallizing and fully austenizing the structure of the electroslag ingot at a high temperature; and cooling by water after the solution treatment. Then carrying out forging treatment of the electroslag ingot after solution treatment, i.e., soaking at 1050° C. in the heating furnace for 2 h, and raising the temperature to 1100° C. within 0.5 h before forging, wherein the initial forging temperature is not less than 1050° C., and the final forging temperature is not less than 900° C. during forging; forging for multiple times to obtain a billet with a width of 100 mm and a thickness of 85 mm, and cooling the billet to room temperature.

(5) Preparation of high nitrogen steel for ocean engineering: placing the forged square billet in the heating furnace, soaking at 1050° C. for 2 h, and raising the temperature to 1100° C. within 0.5 h; starting hot rolling at 1000° C., and finishing the hot rolling at 890° C.; after rolling, cooling the square billet to room temperature by air or water, thus to obtain the high nitrogen steel for ocean engineering.

Embodiment 3

A high nitrogen steel with high strength, low yield ratio and high corrosion resistance for ocean engineering, specifically comprising the following chemical components by mass percentage: C 0.01%, Si 0.1%, Cr 19%, Mn 16%, Mo 1.5%, Ti 0.05%, N 0.6%, P 0.01%, S 0.01%, O 0.02%, and the balance of iron and residual trace impurities.

A preparation method for the high nitrogen steel with high strength, low yield ratio and high corrosion resistance for ocean engineering, specifically comprising the following steps:

(1) Determining nitrogen content in the components according to a target nitrogen content of the high nitrogen steel using a formula ① which is as follows:

$$[\%\ N]_1=[\%\ N]-(0.2-0.4)$$

Where, $[\%\ N]_1$ represents a target nitrogen mass percentage of the ingot, and [% N] represents a calculated nitrogen mass percentage of the high nitrogen steel.

Calculating the weight of each raw material and preparing a smelting raw material in combination with the components of a target steel grade, the components of the smelting raw material and the weight of a smelting ingot.

(2) Ingot preparation: placing the industrial pure iron, the low carbon ferrochromium, ½ by weight of the electrolytic manganese and the ferromolybdenum in a crucible of an induction furnace, and placing the remaining electrolytic manganese in a hopper. Vacuumizing the induction furnace to 17 Pa, and energizing to raise the temperature until all the raw materials in the furnace are melted. After all the raw materials in the furnace are melted, introducing nitrogen into the furnace to a pressure of 80000 Pa and opening a bottom nitrogen blowing valve to stir the liquid steel and make the components of the liquid steel uniform; adding the electrolytic manganese into the furnace in batches by 3 times; after the added manganese is melted, adding an alloy of the chromium nitride and the nitrogenized manganese in batches by 6 times; adding aluminum for deoxidation; and finally adding titanium. Controlling the temperature in the furnace between 1550-1560° C.; after all the materials are melted, sampling and carrying out rapid casting with a casting temperature of 1560° C.; after casting, cooling to room temperature, and taking out the ingot.

(3) Electroslag ingot preparation: forging the ingot into an electrode rod of φ=80 mm at 1100° C., welding the electrode rod onto a dummy electrode, and installing the dummy electrode on an electrode holder.

Closing a protective cover, introducing nitrogen to purge the bottom of the furnace, removing the air in the remelting furnace, setting the average voltage of the electroslag remelting to 25 V and the average current of the electroslag remelting to 2500 A, carrying out electroslag remelting and smelting under the protection of high-purity nitrogen atmosphere, thus to obtain the electroslag ingot.

Detecting the components of the sample taken out during smelting, inputting the components of the ingot into a Factsage software to calculate the phase diagram of the high nitrogen steel, and finding out the temperature range of an austenitic area according to the phase diagram, wherein the temperature range of the steel grade of the present invention is 900-1130° C.

(4) Square billet preparation: placing the obtained electroslag ingot in a heating furnace for solution treatment; the heating temperature is 1050° C., and the in-furnace time of the casting billet is 20 h; dissolving the nitride in the electroslag ingot, and recrystallizing and fully austenizing the structure of the electroslag ingot at a high temperature; and cooling by water after the solution treatment. Then carrying out forging treatment of the electroslag ingot after solution treatment, i.e., soaking at 1050° C. in the heating furnace for 2 h, and raising the temperature to 1100° C. within 0.5 h before forging, wherein the initial forging temperature is not less than 1050° C., and the final forging temperature is not less than 900° C. during forging; forging for multiple times to obtain a billet with a width of 100 mm and a thickness of 85 mm, and cooling the billet to room temperature.

(5) Preparation of high nitrogen steel for ocean engineering: placing the forged square billet in the heating furnace, soaking at 1050° C. for 2 h, and raising the temperature to 1100° C. within 0.5 h; starting hot rolling at 1100° C., and finishing the hot rolling at 930° C.; after rolling, cooling the square billet to room temperature by air or water, thus to obtain the high nitrogen steel for ocean engineering.

Reference Example 1

A preparation method for the high nitrogen steel with high strength, low yield ratio and high corrosion resistance for ocean engineering, which is different from embodiment 1 in that:

In step (5), the solution treatment temperature of a slab after hot rolling is 1000° C., and the in-furnace time of the casting billet is 2 h.

Technical Effects:

Tensile property experiments are carried out twice respectively on the products obtained by embodiment 1 of the present invention and reference example 1. The implementation standard is GB/T228.1-2010, and the strengths are all above 500 MPa. The specific property results are shown in Table 1.

TABLE 1

Mechanical properties of steel of the present invention in hot rolling state and after solution treatment

| Steel grade | Yield strength Rp | Tensile strength Rm | Yield ratio | Percentage elongation after fracture | Section shrinkage | Product of tensile strength and elongation |
|---|---|---|---|---|---|---|
| Embodiment 1 | 884 MPa | 1157 MPa | 0.764 | 24.44% | 61.92% | 26.62 GPa % |
| Embodiment 1 | 887 MPa | 1089 MPa | 0.815 | 25.32% | 60.96% | 29.30 GPa % |
| Reference example 1 | 519 MPa | 929 MPa | 0.559 | 35.2% | 68.72% | 32.49 GPa % |
| Reference example 1 | 517 MPa | 923 MPa | 0.560 | 37.48% | 69.22% | 34.82 GPa % |

The product manufactured by the present invention is soaked at 800° C., 900° C., 1000° C., 1100° C. and 1200° C. for 1 h, 3 h and 5 h respectively and sampled, the potentiodynamic polarization curves of the product manufactured by the present invention as well as 316, 316L and 06Cr18Ni9 stainless steel are plotted, and the chemical immersion corrosion test results (Table 2) and FIG. 2 of the steel of the present invention and 316L stainless steel under different solution treatment processes are obtained.

TABLE 2

| Specimen | Surface area $A/cm^2$ | Mass before corrosion $D_0/g$ | Mass after corrosion $D_8/g$ | Total weight loss rate/(%) | Corrosion rate/$(g \cdot cm^{-2} \cdot h^{-1})$ |
|---|---|---|---|---|---|
| Room temperature | 2.05 | 1.318 | 1.254 | 4.86 | $1.63 \times 10^{-4}$ |
| 800° C., 1 h | 2.09 | 1.351 | 1.094 | 19.02 | $6.40 \times 10^{-4}$ |
| 800° C., 3 h | 2.05 | 1.293 | 0.971 | 24.90 | $8.18 \times 10^{-4}$ |
| 800° C., 5 h | 2.06 | 1.320 | 1.035 | 21.59 | $7.21 \times 10^{-4}$ |
| 900° C., 1 h | 2.06 | 1.286 | 1.213 | 5.68 | $1.85 \times 10^{-4}$ |
| 900° C., 3 h | 2.00 | 1.295 | 1.222 | 5.64 | $1.90 \times 10^{-4}$ |
| 900° C., 5 h | 2.02 | 1.242 | 1.119 | 9.90 | $3.17 \times 10^{-4}$ |
| 1000° C., 1 h | 2.13 | 1.342 | 1.312 | 2.24 | $7.34 \times 10^{-5}$ |
| 1000° C., 3 h | 2.01 | 1.196 | 1.167 | 2.42 | $7.51 \times 10^{-5}$ |

TABLE 2-continued

| Specimen | Surface area $A/cm^2$ | Mass before corrosion $D_0/g$ | Mass after corrosion $D_8/g$ | Total weight loss rate/(%) | Corrosion rate/$(g \cdot cm^{-2} \cdot h^{-1})$ |
|---|---|---|---|---|---|
| 1000° C., 5 h | 1.98 | 1.272 | 1.256 | 1.26 | $4.21 \times 10^{-5}$ |
| 1100° C., 1 h | 1.93 | 1.192 | 1.187 | 0.42 | $1.35 \times 10^{-5}$ |
| 1100° C., 3 h | 1.87 | 1.132 | 1.123 | 0.80 | $2.51 \times 10^{-5}$ |
| 1100° C., 5 h | 1.84 | 1.137 | 1.078 | 5.19 | $1.67 \times 10^{-4}$ |
| 1200° C., 1 h | 2.13 | 1.369 | 1.318 | 3.73 | $1.25 \times 10^{-4}$ |
| 1200° C., 3 h | 2.06 | 1.306 | 1.110 | 15.01 | $4.96 \times 10^{-4}$ |

Table 2 shows the surface area, weight, total weight loss rate and average corrosion rate of the specimens of the steel of the present invention and 316L stainless steel immersed and corroded in 6% $FeCl_3$ solution for 8 days. It can be seen from the table that the corrosion resistance of the steel of the present invention is better than that of 316L steel after solution treatment at 1000° C. and 1100° C., wherein the corrosion resistance after solution treatment at 1100° C. for 1 h is the best, and the total weight loss rate and corrosion rate after 8 days are only 0.42%.

It can also be seen that the corrosion resistance of the steel of the present invention after solution treatment at 1000° C. and 1100° C. is better than that of 316L steel with a higher price, while the corrosion resistance of the high nitrogen steel after solution treatment at 8000° C. is slightly poor because the steel grade precipitates part of Cr2N from the austenitic matrix, which makes the corrosion resistance thereof relatively poor.

Each embodiment in the description is described in a progressive way. The difference of each embodiment from each other is the focus of explanation. The same and similar parts among all of the embodiments can be referred to each other. For a device disclosed by the embodiments, because the device corresponds to a method disclosed by the embodiments, the device is simply described. Refer to the description of the method part for the related part.

The above description of the disclosed embodiments enables those skilled in the art to realize or use the present invention. Many modifications to these embodiments will be apparent to those skilled in the art. The general principle defined herein can be realized in other embodiments without departing from the spirit or scope of the present invention. Therefore, the present invention will not be limited to these embodiments shown herein, but will conform to the widest scope consistent with the principle and novel features disclosed herein.

What is claimed is:

1. A preparation method for high nitrogen steel for ocean engineering, wherein the high nitrogen steel for ocean engineering comprises the following chemical components by weight percentage: C≤0.01%, Si≤0.1%, Cr 17%-19%, Mn 14%-16%, Mo 1%-1.5%, Ti≤0.05%, N 0.45%-0.6%, P<0.01%, S≤0.01%, O≤0.02%, and a balance of iron;

the preparation method comprising the following steps:

S1 raw material weighing: calculating and weighing raw materials including industrial pure iron, low carbon ferrochromium, electrolytic manganese, ferromolybdenum, chromium nitride, nitrogenized manganese, aluminum and titanium for later use;

S2 ingot preparation, remelting and smelting: melting, casting and cooling the above raw materials to form an ingot, and carrying out electroslag remelting and smelting of the ingot under nitrogen protection, thus obtaining an electroslag ingot;

S3 solution and forging treatments: carrying out solution treatment of the electroslag ingot at 1000° C.-1050° C. for 20 h-24 h and then cooling the electroslag ingot using water; carrying out forging treatment with an initial forging temperature of not less than 1050° C. and a final forging temperature of not less than 900° C. during forging; after forging, cooling the electroslag ingot to room temperature using air, thus obtaining a square billet; and S4 hot rolling and post-rolling treatment: placing the square billet in a heating furnace, soaking at 1050° C. for 2 h, and raising the temperature to 1100° C. within 0.5 h; starting hot rolling at 1000-1100° C., and finishing the hot rolling at 890-930° C.; after rolling, cooling the square billet to room temperature using air or water, thus obtaining the high nitrogen steel for ocean engineering.

2. The preparation method for high nitrogen steel for ocean engineering according to claim 1, wherein the calculation in S1 comprises determining nitrogen content in the components using a formula 1 which is as follows:

$$[\%\ N]_1=[\%\ N]-(0.2-0.4);$$

where, $[\%\ N]_1$ represents a target nitrogen mass percentage of the ingot;

[% N] represents a calculated nitrogen mass percentage of the high nitrogen steel.

3. The preparation method for high nitrogen steel for ocean engineering according to claim 1, wherein the ingot preparation in S2 specifically comprises the following steps:

placing the industrial pure iron, the low carbon ferrochromium, ½-⅔ by weight of the electrolytic manganese and the ferromolybdenum in a crucible of an induction furnace with a vacuum degree of 17 Pa for melting completely; introducing nitrogen to replace air, and using the nitrogen to stir liquid steel uniformly; then adding the remaining electrolytic manganese into the furnace in batches 2-3 times, and heating and soaking until the remaining electrolytic manganese is completely melted; adding the chromium nitride, the nitrogenized manganese and the aluminum in batches 3-6 times in turn, and carrying out deoxidation; and finally adding the titanium, heating and soaking until the titanium is completely melted, and sampling and carrying out rapid casting and cooling, thus obtaining the ingot.

4. The preparation method for high nitrogen steel for ocean engineering according to claim 3, wherein the melting temperature in the crucible of the induction furnace is 1550-1560° C.

5. The preparation method for high nitrogen steel for ocean engineering according to claim 3, wherein a pressure in the crucible of the induction furnace after nitrogen is introduced is 80000 Pa.

6. The preparation method for high nitrogen steel for ocean engineering according to claim 3, wherein a casting temperature is 1530-1560° C.

7. The preparation method for high nitrogen steel for ocean engineering according to any one of claims 1 and 3-6, wherein the electroslag remelting and smelting specifically comprises the following steps:

31) forging the ingot into a consumable electrode according to requirements of an electroslag remelting furnace, welding the consumable electrode onto a dummy electrode, and installing the dummy electrode on an electrode holder;

32) closing a protective cover, introducing nitrogen to purge the bottom of the furnace, removing the air in the remelting furnace, carrying out electroslag remelting and smelting under the protection of high-purity nitrogen atmosphere, thus to obtain the electroslag ingot.

8. The preparation method for high nitrogen steel for ocean engineering according to claim 1, wherein in S3, the temperature is raised to 1100° C. within 0.5 h before the forging.

* * * * *